United States Patent [19]

Oshkin et al.

[11] 4,442,312

[45] Apr. 10, 1984

[54] END PIECE OF BIPOLAR WATER-COOLED CABLE

[76] Inventors: Anatoly I. Oshkin, bulvar Koroleva, 10 kv. 58; Mikhail D. Banov, Ulitsa Belorusskaya, 25, kv. 30; Alexandr N. Chernyshev, ulitsa Frunze, 20, kv. 56, all of Tolyatti, U.S.S.R.

[21] Appl. No.: 417,114

[22] PCT Filed: Jan. 28, 1981

[86] PCT No.: PCT/SU81/00009

§ 371 Date: Sep. 2, 1982

§ 102(e) Date: Sep. 2, 1982

[87] PCT Pub. No.: WO81/02617

PCT Pub. Date: Aug. 5, 1982

[51] Int. Cl.[3] ..... H01B 7/34

[52] U.S. Cl. ..... 174/15 WF; 174/19

[58] Field of Search ..... 174/15 C, 15 WF, 19; 339/117 R; 219/137.9

[56] References Cited

U.S. PATENT DOCUMENTS

| | | | |
|---|---|---|---|
| 2,113,516 | 4/1938 | Possenti . | |
| 3,127,467 | 3/1964 | Toto | 174/19 |
| 3,244,792 | 4/1966 | Smith | 174/19 |
| 3,784,722 | 1/1974 | Goodman | 174/15 C |
| 3,872,232 | 3/1975 | Goodman | 174/15 WF X |
| 3,952,141 | 4/1976 | Hubner | 174/15 WF X |

*Primary Examiner*—J. V. Truhe
*Assistant Examiner*—Morris H. Nimmo
*Attorney, Agent, or Firm*—Lilling and Greenspan

[57] ABSTRACT

An end piece of a bipolar water-cooled cable comprises two parts rigidly secured together via a sealing insulation gasket. The first part features sockets for connection of current-carrying conductors of one polarity, an opening for connection to a cooling water source, communicating with spaces of the cable cooling system, and a recess. The second part has an insert extending beyond the butt of said part, which can fit into the recess via an insulation gasket and is intended to connect current-carrying conductors of the opposite polarity. The portion of the insert protruding beyond the butt thereof is cylindrical in shape, extends to a length not less than 2.5 diameters thereof and features a blind hole which is the socket whereto the current-carrying conductors of the opposite polarity are connected. A sleeve of an insulating material is rigidly secured on the insert so that it extends beyond the butt of the insert.

The cable end piece is designed for cables used in welding to connect a power transformer to a portable welding gun.

3 Claims, 2 Drawing Figures

END PIECE OF BIPOLAR WATER-COOLED CABLE

FIELD OF THE INVENTION

The present invention relates to electrical engineering and, in particular, to an end piece of a bipolar water-cooled cable.

DESCRIPTION OF THE PRIOR ART

Known in the art is an end piece of a bipolar flexible water-cooled cable, comprising two sturdy rings rigidly secured to each other through insulating and sealing spacers. One of the rings is connected to current-carrying strands of one polarity, while the other ring is connected to current-carrying strands of the opposite polarity (cf., for example, Reference Book of Welding, edited by S. V. Sokolov, vol. I, Moscow, 1961, p.368).

The end piece of such a design is bulky and heavy, the field of application being thus limited.

Also known in the art is an end piece of a bipolar water-cooled cable, comprising two members rigidly secured together through a sealing spacer. One member is provided with jacks to connect current-carrying conductors of one polarity and an opening to connect to a cooling water source, which is associated with spaces of the cable cooling system. In addition, this member of the cable end piece is provided with a groove. The other member of the cable end piece has an insert welded thereto, extending beyond the member and having the shape of a tee-joint. Current-carrying conductors of the opposite polarity are connected to this member. An insert of one member of the cable end piece fits into a recess in the other member, which a space-saving techique of separating conductors at cable ends and assemble the end pieces. Insulating spacers are provided between the insert and the recess, and between the members of the end piece. The members of the end piece are drawn together by a bolt fitted with an insulating washer. A sealing braid prevents water leakage between the insulation and members of the end piece (cf., for example, Collection of Articles by NIITavtoprom, Practical Experience of Volzhsky Plant, Welding series, Moscow, 1971, pp.11 and 76, pos.19, in Russian).

The known end piece is compact but does nothing to prevent sharp bending of conductors where they are connected to the cable end piece, which may be due to electrodynamic jerks or mechanical twist of the cable in the process of work. Such bends can be the cause of premature fracture of strands or rupture of insulation between conductors of opposite polarities leading to short circuits.

SUMMARY OF THE INVENTION

It is an object of this invention to provide an end piece of a bipolr water-cooled cable, having rigid isolation of the conductors at the splicing points, which prevents bends and rupture of conductors, thus prolonging the cable service life.

The invention provides an end piece of a bipolar water-cooled cable, comprising two parts rigidly secured together with a sealing insulation spacer fit between them. One part is provided with sockets to connect current-carrying conductors of one polarity, an opening to be connected to a cooling water source, associated with spaces of the cable cooling system, and a recess. The other part is provided with an insert extending beyond the butt end thereof and fitted, through an insulation spacer, in the recess in order to connect current-carrying conductors of the opposite polarity. According to the invention, the portion of the insert extending beyond the butt end is cylindrical in shape, protrudes to a length not less than 2.5 diameters thereof and features a blind central hole which is the socket for connection of current-carrying conductors of the opposite polarity. A sleeve of an insulation material is rigidly secured on said insert and extends beyond the insert butt end.

Advisably, the sleeve should be provided with an internal annular groove forming a passage for the cooling liquid around the cylindrical portion of the insert.

Desirably, the cylindrical portion of the insert should be provided with length-wise and radial ducts associating with spaces of the cable cooling system.

An end piece of a bipolar water-cooled cable, according to the present invention, ensures rigid isolation of current-carrying conductors of both polarities, which prevents premature fracture and short-circuiting of conductors near the end piece of the cable. The end piece requires no complex manufacturing equipment.

BRIEF DESCRIPTION OF THE DRAWINGS

The invention will now be described in more detail, by way of example, with reference to the accompanying drawings, in which.

BEST MODE FOR CARRYING OUT THE INVENTION

Figure 1:
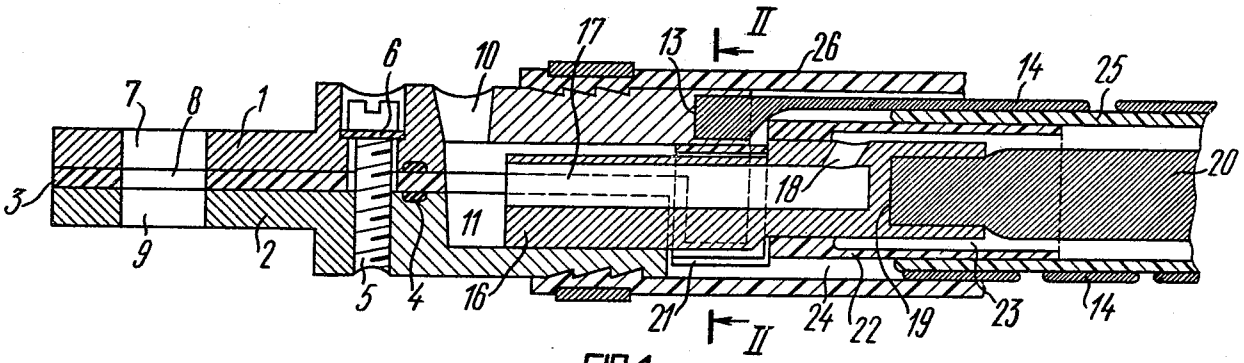
FIG. 1 is a length-wise sectional view of an end piece of a bipolar water-cooled cable.
Figure 2:
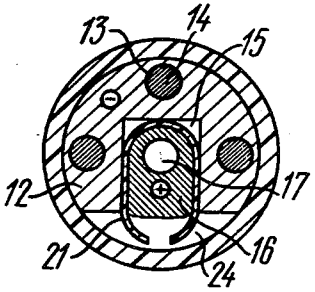
FIG. 2 is a sectional view taken along line II—II of FIG. 1.

An end piece of a bipolar water-cooled cable comprises two parts 1 (FIGS. 1 and 2) and 2 rigidly secured together through an insulating gasket 3 and a sealing gasket 4 by means of bolts. A connecting bolt 5 is isolated from the part 1 of the end piece by a fabric-based laminate washer 6. The part 1 is provided with an opening 7, the gasket 3 is provided with an opening 8, and the part 2 is provided with an opening 9, all openings being arranged coaxially and intended to connect the end piece of the cable to a power source (not shown). The part 1 of the cable end piece features an opening 10 threaded to associate a space 11 of the end piece with a cooling water source (not shown). At the tip of the part 1 there is provided a cylindrical projection 12, and sockets 13 are drilled about the circumference thereof to connect current-carrying conductors 14 of one polarity. A rectangular recess 15 is cut in the part 1 of the cable end piece including the projection 12. The part 2 of the cable end piece has an insert 16 extending beyond the butt of said part and fitting into the recess 15. The extending portion of the insert 16 is cylindrical in shape and not less than 2.5 diameters in length. The insert 16 features a lengthwise axis duct 17 communicating with the space 11 and radial ducts 18. The cylindrical portion of the insert 16 has a blind central hole 19 for connection of a current-carrying conductor 20 of the opposite polarity. The surface of the insert 16 is insulated from the part 1 of the cable end piece by a dielectric gasket 21. A sleeve 22 made from an insulation material is rigidly secured on the insert 16 and extends beyond the butt end of the insert 16. The sleeve 22 is secured on the insert 16 by a threaded joint and features an internal annular groove forming an annular passage 23 around the cylindrical portion of the insert 16, intended to let pass the cooling water from the space 11, along the ducts 17 and 18, to the current-carrying conductor 20. The section of the annular passage 23 exceeds the section of the lengthwise duct 17 by 15 percent. This permits inflow of the cooling water from the space 11 to a space 24 around the insert 16 and to the current-carrying conductors 14, as well as to the current-carrying conductor 20.

The sleeve 22 extends beyond the butt of the insert 16 to a length equal to the diameter of the cylindrical portion of the insert 16. In addition to insulation, the sleeve 22 performs the function of a mounting for a dielectric plastic sheath 25 which insulates unlike conductors 14 and 20 throughout the length of the cable. A critically loaded portion of a water-cooled flexible bipolar cable is the place where conductors 14 and 20 are spliced to join the end piece of the cable.

The current-carrying conductors 14 and 20 are often broken in these joints due to electrodynamic jerks or mechanical bending of cables in the process of operation, of, for example, welding guns.

Prevention of premature breakage of the current-carrying conductors 14 and 20 is achieved in a cable end piece, according to the invention, by a more rigid connection of the conductors 14 and 20 near the end piece. This more rigid connection consists in that the conductors 20 near the butt of the part 2 of the end piece cannot bend due to the portion of the sleeve 22 extending beyond the insert 16, while the conductors 14 cannot bend near the part 1 of the end piece because their radial movement is limited by the external surface of the rigid sleeve 22 extending to a substantial length and the internal surface of the protective sleeve 26.

A cable end piece, according to the invention, while being compact, prevents intensive wear of current-carrying conductors near the splice points due to their rigid isolation, which allows for a substantial improvement of the cable reliability.

Industrial Applicability

An end piece of a bipolar water-cooled cable can be used for isolation of current-carrying conductors in cables intended for transmission of heavy (5–20 KA) current loads between objects whose relative position changes in the process of work, in particular, during welding to connect the power transformer to a portable welding gun.

We claim:

1. An end piece of a bipolar water-cooled cable comprising a cable cooling system means; a first part having sockets to connect current-carrying conductors of one polarity, an opening for connection to a cooling water source and communicating with spaces of said cable cooling system, and a recess; a second part rigidly secured to said first part; sealing insulation gasket means inserted between said first and second parts; an insert of said second part extending beyond a butt end of said second part and fitting through an insulation gasket in said recess of said first part, a portion of said insert extending beyond the butt end of said second part being cylindrical in shape and extending to a length not less than 2.5 diameters of the insert, said insert having a blind central hole for connecting the current-carrying conductors of the opposite polarity; and a sleeve made of an insulating material and rigidly secured on said insert and extending beyond an end of said insert.

2. An end piece of a bipolar water-cooled cable as claimed in claim 1, wherein the sleeve has an internal annular groove forming a passage for the cooling liquid around the cylindrical portion of the insert.

3. An end piece of a bipolar water-cooled cable as claimed in claim 2, wherein the cylindrical portion of the insert has lengthwise and radial ducts communicating with the spaces of the cable cooling system.

* * * * *